US007528740B2

(12) United States Patent
Hess et al.

(10) Patent No.: US 7,528,740 B2
(45) Date of Patent: May 5, 2009

(54) METHOD FOR PROVIDING INFORMATION FOR PARALLEL PARKING OF A VEHICLE

(75) Inventors: Steffen Hess, Sachsenheim (DE); Jan Egelhaaf, Leonberg (DE); Joline Belfroid-Van Der Putten, Leonberg (DE); Thomas Guelzow, Korntal-Muenchingen (DE)

(73) Assignee: Robert Bosch GmbH, Stuttgart (DE)

( * ) Notice: Subject to any disclaimer, the term of this patent is extended or adjusted under 35 U.S.C. 154(b) by 20 days.

(21) Appl. No.: 11/732,164

(22) Filed: Apr. 2, 2007

(65) Prior Publication Data

US 2007/0268157 A1 Nov. 22, 2007

(51) Int. Cl.
*G08G 1/14* (2006.01)

(52) U.S. Cl. ..... 340/932.2

(58) Field of Classification Search ..... 340/932.2
See application file for complete search history.

(56) References Cited

U.S. PATENT DOCUMENTS

| | | | | |
|---|---|---|---|---|
| 6,483,442 | B2 * | 11/2002 | Shimizu et al. | 340/932.2 |
| 7,248,153 | B2 | 7/2007 | Danz et al. | |
| 7,263,420 | B2 * | 8/2007 | Tanaka et al. | 701/36 |
| 7,295,227 | B1 | 11/2007 | Asahi et al. | |
| 7,379,564 | B2 * | 5/2008 | Kakinami et al. | 382/104 |
| 2002/0041239 | A1 | 4/2002 | Shimizu et al. | |
| 2003/0080877 | A1 * | 5/2003 | Takagi et al. | 340/932.2 |
| 2004/0130464 | A1 * | 7/2004 | Schindler et al. | 340/932.2 |
| 2005/0057374 | A1 * | 3/2005 | Tanaka et al. | 340/932.2 |

FOREIGN PATENT DOCUMENTS

| | | |
|---|---|---|
| CN | 2156076 | 2/1994 |
| DE | 38 44 340 | 7/1990 |
| DE | 196 16 447 | 10/1997 |
| GB | 2 319 420 | 5/1998 |
| WO | WO 1997/47991 | 12/1997 |

* cited by examiner

*Primary Examiner*—Daniel Wu
*Assistant Examiner*—John F Mortell
(74) *Attorney, Agent, or Firm*—Kenyon & Kenyon LLP

(57) ABSTRACT

A method for providing information for the driver of a vehicle for parallel parking of the vehicle includes sending the driver information about the length (size) of the parking spot in relation to the length (size) of the vehicle. After detection of the first obstacle (or end point) delimiting the length of the parking spot, the vehicle and its position are displayed in relation to the parking spot or the already detected part of the parking spot, on a display unit assigned to the driver. The ratio of the vehicle length to the length of the parking spot or the detected part of the parking spot corresponds to the ratio of the displayed vehicle length to the length of the displayed parking spot or the displayed part of the parking spot.

11 Claims, 3 Drawing Sheets

METHOD FOR PROVIDING INFORMATION FOR PARALLEL PARKING OF A VEHICLE

FIELD OF THE INVENTION

The present invention relates to a method for providing information for assisting in parallel parking of a vehicle.

BACKGROUND INFORMATION

Growing traffic density and the increased development of open spaces, in metropolitan areas in particular, continuously constrict the room for traffic movement. The available parking spaces are becoming smaller and the search for a suitable parking spot, in addition to the continuously growing traffic volume, puts an extra burden on the driver. When backing into a parking spot in particular, it is frequently considerably difficult to correctly judge the exact size and position of the parking spot.

Known in the automobile art are driver assist systems for vehicles which assist the driver in various driving situations, e.g., when maneuvering or pulling into and out of parking spots. Among other things, systems for measuring parking spots are known which, when driving past the parking spot, inform the driver in a suitable manner about the size of the parking spot so that, based on this information, the driver is able to make a sufficiently safe decision/prognosis on whether parking in this parking spot is reasonable. It is known to measure the size of the parking spot using sensors on the side of the vehicle, e.g., ultrasound sensors, and to communicate this measured value to the driver in a suitable manner.

It is disadvantageous in the known parking spot measuring systems that the driver of the vehicle must initially relate the measured value of the parking spot measurement to the vehicle length in order to decide, based on the relationship of vehicle length and parking spot length, whether the measured parking spot has a suitable length for parking. This procedure requires some concentration resulting in the driver's attention toward the traffic situation being adversely reduced.

Therefore, it is an object of the present invention to provide a method for providing the driver of a vehicle with information for parallel parking the vehicle in a parking spot delimited by (at least) two end points, e.g., obstacles, via which the driver is informed particularly quickly and in a particularly suitable manner about the length (size) of the parking spot in relation to the length (size) of the vehicle. The driver is to be distracted from the traffic situation as minimally as possible.

SUMMARY

Due to the fact that after the detection of a first obstacle (or end point) delimiting the length of the parking spot, the vehicle and its position relative to an already detected part of the parking spot are shown on a display assigned to the driver, the ratio of the vehicle length and parking spot length or the detected part of the parking spot is shown on the display, the vehicle driver obtains suitable information about the relationship of vehicle length and parking spot length based on the true-to-scale display while the vehicle is passing the parking spot defined by the two obstacles (or end points), and thus during the measurement of the parking spot length. The important advantage of the method according to the present invention is that it is not the absolute length of the parking spot that is communicated to the driver (e.g., visually, acoustically, haptically), but rather that the relationship of vehicle length and parking spot length is graphically displayed. The absolute length of the parking spot is not essential for deciding whether or not the parking spot to be measured is large enough, instead only the relationship of vehicle length and parking spot length is essential. It is necessary for the length of the parking spot to exceed the vehicle length in order to allow parking in the parking spot. Based on the true-to-scale visual display of the vehicle and the parking spot according to the present invention, the driver receives information in a particularly suitable manner while passing the parking spot about the prospects of a successful parking operation, the distraction from the traffic situation being minimal.

An example embodiment of the method according to the present invention provides for the length of the already measured part of the parking spot to be displayed in relation to the minimum length needed for parking, subsequent to the detection of the first obstacle which delimits the parking spot length, and prior to the detection of the second obstacle. A further embodiment of the present invention provides for the already detected part of the parking spot to be displayed in a predefined color as a function of its length during the parking spot measurement. One example approach provides for the part of the parking spot already detected during the parking spot measurement to be displayed in red, provided that its length is less than the minimum length for parking the vehicle. This makes it possible for the vehicle driver to recognize while passing the parking spot, based on the color red, that the part of the parking spot measured so far is not sufficiently large for parking. If the part of the parking spot already measured while the vehicle passes the parking spot has a length which is greater than or equal to the minimum length for parking the vehicle in the parking spot, and if this already measured part is not or only slightly greater than this minimum length so that driving into the parking spot is not comfortably ensured, an example embodiment provides for display, in yellow, of the already measured part of the parking spot or of the segment of the already measured part of the parking spot which exceeds the minimum length of the parking spot. In this case, the color yellow informs the driver that the parking spot is sufficient for parking but is not long enough for comfortable and easy parking (without pulling in and out multiple times). If the parking spot measurement shows that the measured parking spot has a length which makes easy driving into the parking spot possible, the already measured part is displayed in green, in one example embodiment. In this case, the green display of the parking spot indicates to the driver that the parking spot is long enough for easy parking.

Analogous to the above-mentioned color representation of the parking spot during the parking spot measurement, one variant of the present invention provides for display of the parking spot in a predefined color after detection of the second obstacle (end point) delimiting the parking spot, as a function of its length. The parking spot measuring process is completed after detection of the second obstacle and the length of the parking spot is established. The color representation signals to the driver in a rapid and simple manner whether the parking spot is too small (color red), sufficient—but tight—(color yellow), or sufficient for easy parking (color green).

The vehicle and the already measured part of the parking spot, as well as the vehicle's position in relation to the already detected and measured part of the parking spot, are displayed in a perpendicular top view via a display unit assigned to the driver. The actual driving direction of the vehicle corresponds to the displayed driving direction of the vehicle.

Subsequent to the detection of the second obstacle (end point) delimiting the length of the parking spot, the parking spot measuring system is immediately active again in order to measure additional parking spots. The parking spot measurement ends either after a second obstacle is detected or when the size of the parking spot is determined to be sufficient for easy parking without another obstacle being detected. (The parking spot is thus delimited by only one vehicle). Also in this case, the parking spot measuring system is immediately active again in order to measure additional parking spots. The present invention also provides for the driver to optionally also be able to manually re-start the parking spot measuring system.

A further example embodiment provides for the vehicle's position data and the parking spot's position data to be stored during the parking spot measurement so that, if needed, the driver is able to re-display a predefined number of previously measured parking spots on the display unit. This is particularly advantageous in areas of tightly limited parking space supply when several parking spots are available which have the minimum size but are tight. The vehicle driver may then drive past all parking spots, the length of the respective parking spot being measured and stored during passing. Using the stored parking spot measurements, the driver is then able to compare the individual parking spots with respect to their length and select one of the parking spots.

DETAILED DESCRIPTION

Figure 1:
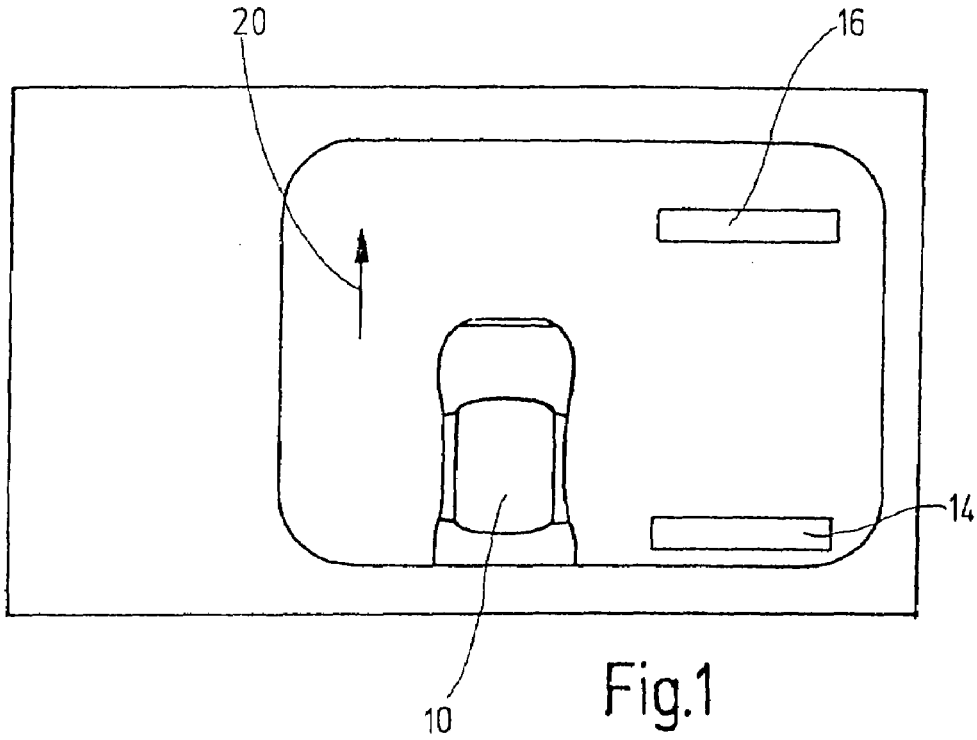
FIG. 1 shows a schematic representation of display information for parking spot measurement according to the present invention at the beginning of the parking spot measurement.
Figure 2:
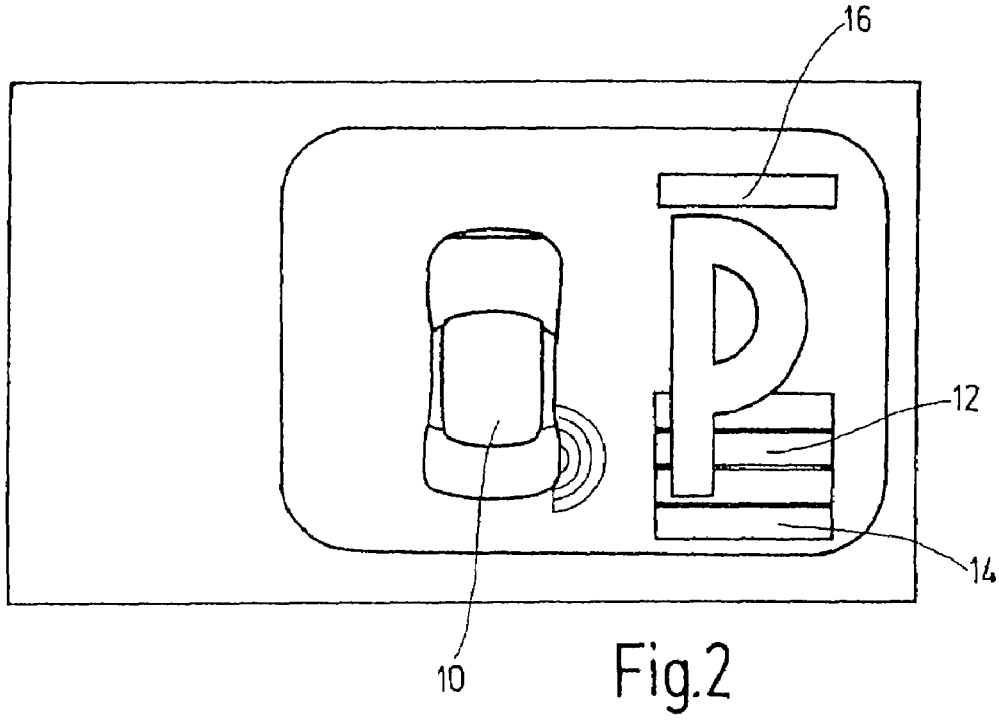
FIGS. 2 and 3 show schematic representations of display information for parking spot measurement according to the present invention during two different points of the parking spot measurement.
Figure 3:
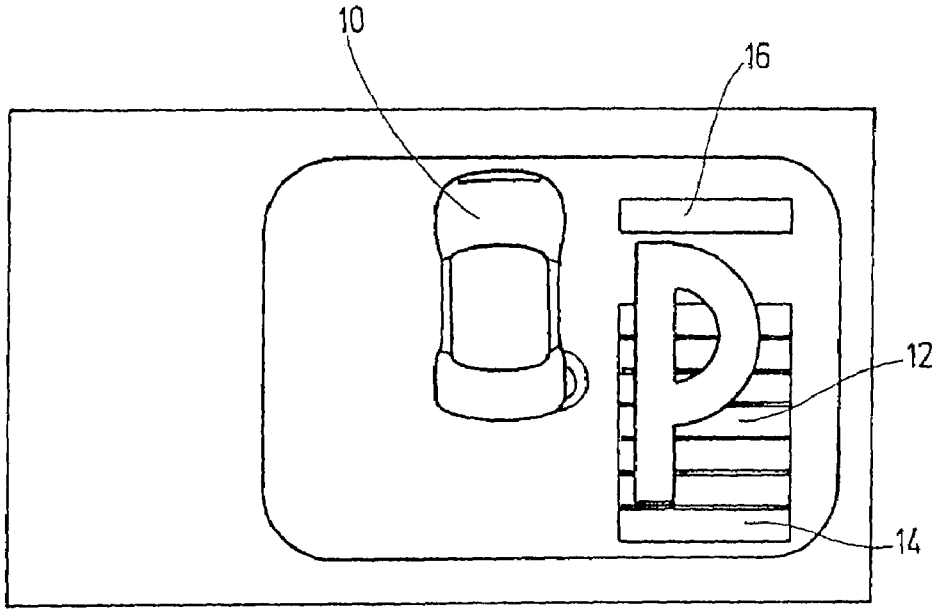
Figure 4:
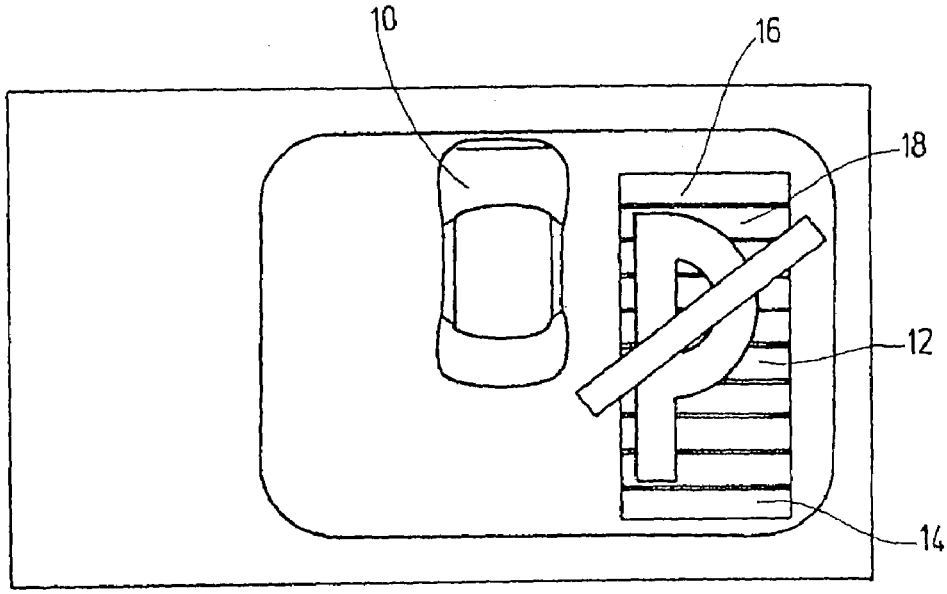
FIGS. 4 and 5 show schematic representations of different display information for parking spot measurement according to the present invention after the completed parking spot measurement.
Figure 5:
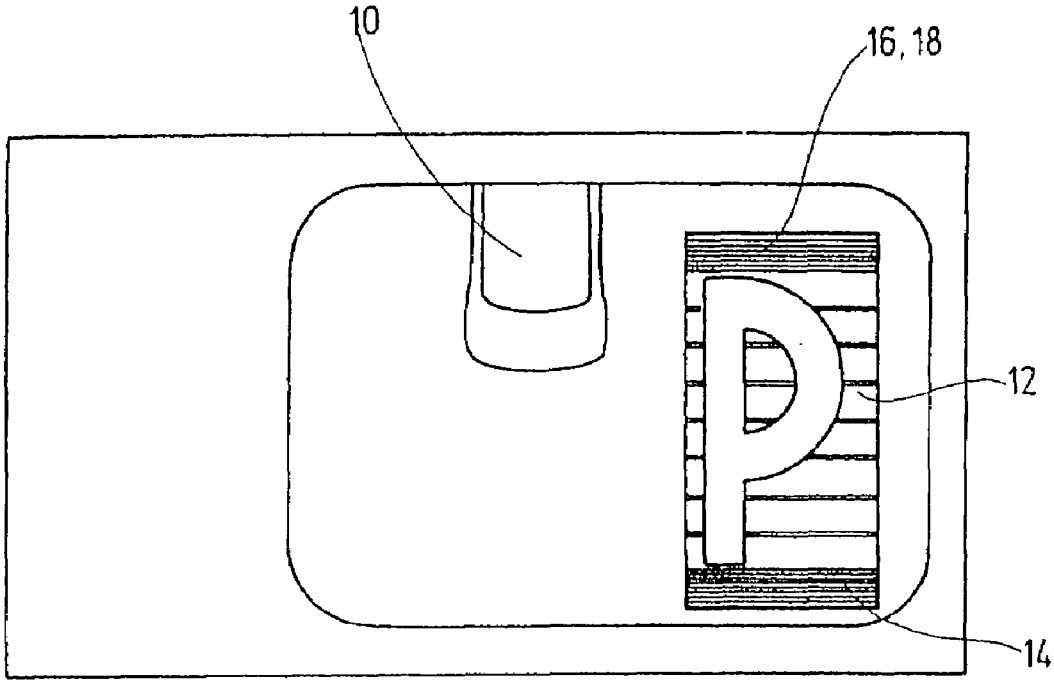

In order to inform the driver of a vehicle about the parking spot measurement, and thus inform in a particularly suitable manner whether the measured parking spot is large enough for parking, the present invention provides for the vehicle and its position in relation to the parking spot or the already detected part of the parking spot to be shown on a display unit assigned to the driver. At the beginning of the measuring process of the parking spot measurement, i.e., when a first obstacle (end point) which delimits the length of the parking spot is detected, vehicle 10, the beginning of parking spot 14 which is represented by the first obstacle (end point), and driving direction 20 are shown on the driver's display unit (FIG. 1). Moreover, an end point 16 of a minimum required parking spot is shown on the display unit. Without looking over the shoulder, which would represent a distraction from the traffic situation, the vehicle driver is able to use this display to ascertain how far past the first obstacle he has gone, as is schematically shown in FIG. 1. The placement on the vehicle of the sensors used for the parking spot measurement is of utmost importance for establishing how far past the first obstacle he has gone in order to be able to detect the obstacle. Already measured part 12 of the parking spot is constantly displayed during the vehicle's further passing of the parking spot to be measured (FIGS. 2 and 3). The vehicle driver is informed in a particularly suitable manner how large the already measured part of the parking spot is compared to a parking spot with a minimum required length which is indicated on the display unit by end point 16 (in conjunction with the beginning of parking spot 14). In order to inform the driver as quickly as possible about whether the size of the parking spot (during or after its measurement) is sufficient for parking the vehicle, the ratio of the vehicle length to the length of the parking spot or to the already measured part of the parking spot corresponds to the ratio of the displayed vehicle length (vehicle 10) to the displayed (measured) parking spot or to displayed, already measured part 12 of the parking spot. The absolute length of the parking spot is known after the second obstacle (end point) defining the parking spot is detected. At this point in time, end 18 of the measured parking spot may be graphically displayed to the driver. If the length of the parking spot is less than the minimum required length (FIG. 4), this is indicated by red coloring of the displayed parking spot or displayed part 12 of the parking spot. However, if the parking spot is sufficient (FIG. 5) the parking spot is displayed in the color green. If the parking spot is sufficient but tight, the displayed parking spot or displayed part 12 of the parking spot is shown in yellow.

What is claimed is:

1. A method for providing information to a driver of a vehicle for aiding parallel parking the vehicle in a parking spot having a length defined by a first end point and a second end point, comprising:

measuring the parking spot, wherein the measurement includes detecting the first and second end points defining the length of the parking spot;

determining a position of the vehicle relative to the first and second end points; and displaying on a display unit assigned to the driver, after detection of the first end point and prior to the detection of the second end point, an image of the vehicle and the position of the vehicle relative to one of an image of the parking spot and an image of a detected portion of the parking spot, wherein a ratio of an actual length of the vehicle to one of the length of the parking spot and a length of the detected portion of the parking spot substantially corresponds to a ratio of a length of the image of the vehicle displayed to one of a length of the image of the parking spot displayed and a length of the image of the detected portion of the parking spot displayed.

2. The method as recited in claim 1, wherein, until the second end point is detected, the image of the detected portion of the parking spot is displayed in a predefined color dependent on the length of the detected portion of the parking spot.

3. The method as recited in claim 2, wherein, after the second end point is detected, the image of the parking spot is displayed in a predefined color dependent on the length of the parking spot.

4. The method as recited in claim 2, wherein the image of the vehicle and the position of the vehicle relative to one of the image of the parking spot and the image of the detected portion of the parking spot are displayed from a top view perspective.

5. The method as recited in claim 2, wherein an actual driving direction of the vehicle substantially corresponds to a direction of movement of the image of the vehicle displayed.

6. The method as recited in claim 2, wherein data regarding the vehicle position and the position of the parking spot are stored during the detection of the first end point and the second end point.

7. The method as recited in claim 1, wherein, after the detection of the first end point and prior to the detection of the second end point, the length of the detected portion of the parking spot is displayed in relation to a minimum required length for parking the vehicle.

8. The method as recited in claim 1, wherein:

until the second end point is detected, the image of the detected portion of the parking spot is displayed in a predefined color dependent on the length of the detected portion of the parking spot, after the second end point is detected, the image of the parking spot is displayed in a predefined color dependent on the length of the parking spot, and the image of the vehicle and the position of the vehicle relative to one of the image of the parking spot and the image of the detected portion of the parking spot are displayed from a top view perspective.

9. The method as recited in claim 8, wherein an actual driving direction of the vehicle substantially corresponds to a direction of movement of the image of the vehicle displayed, and wherein data regarding the vehicle position and the position of the parking spot are stored during the detection of the first end point and the second end point.

10. The method as recited in claim 1, wherein after the detection of the first end point and prior to the detection of the second end point, the length of the detected portion of the parking spot is displayed in relation to a minimum required length for parking the vehicle, and wherein the image of the vehicle and the position of the vehicle relative to one of the image of the parking spot and the image of the detected portion of the parking spot are displayed from a top view perspective.

11. The method as recited in claim 10, wherein an actual driving direction of the vehicle substantially corresponds to a direction of movement of the image of the vehicle displayed, and wherein data regarding the vehicle position and the position of the parking spot are stored during the detection of the first end point and the second end point.

* * * * *